US006371087B1

(12) United States Patent
Condran et al.

(10) Patent No.: US 6,371,087 B1
(45) Date of Patent: Apr. 16, 2002

(54) FUEL FILTER AND WATER DRAIN SYSTEM

(76) Inventors: Keith A. Condran, 426 Cherokee Dr., Erie, PA (US) 16505; Paul M. Gunshore, 2430 Taggert St., Erie, PA (US) 16510; Lisa Nanette Huegel, 5136 Kales Way; Mike Sirak, 5907 Sun Ct., both of Erie, PA (US) 16509

( * ) Notice: Subject to any disclaimer, the term of this patent is extended or adjusted under 35 U.S.C. 154(b) by 0 days.

(21) Appl. No.: 09/431,288

(22) Filed: Oct. 29, 1999

(51) Int. Cl.[7] ..... F02M 1/00
(52) U.S. Cl. ..... 123/510; 123/514; 210/774
(58) Field of Search ..... 123/510, 514, 123/25, 511, 512, 509; 210/774, DIG. 5, 799

(56) References Cited

U.S. PATENT DOCUMENTS 4,296,723 A * 10/1981 Aldrich ..... 123/510
4,519,349 A * 5/1985 Cheney ..... 123/198 R
4,860,713 A * 8/1989 Hodgkins ..... 123/510
4,933,093 A * 6/1990 Keller ..... 123/512
4,979,482 A * 12/1990 Bartlett ..... 123/510
5,368,001 A * 11/1994 Roche ..... 123/510
6,029,629 A * 2/2000 Tipton ..... 123/447
6,112,725 A * 9/2000 McKinney ..... 123/509

* cited by examiner

*Primary Examiner*—Carl S. Miller
(74) *Attorney, Agent, or Firm*—Robert L. Wolter, Esq.; Beusse Brownlee Bowdoin & Wolter, PA

(57) ABSTRACT

A fuel filter drain system continuously pumps filtered and water from a locomotive diesel engine fuel filter. A ball valve disposed along the drain line between the fuel filter and the fuel tank is modified to include a ball valve that is approximately 0.031 inches in diameter or sufficiently small to purge the fuel and water, and also maintain fuel pressure within acceptable limits.

5 Claims, 2 Drawing Sheets

FUEL FILTER AND WATER DRAIN SYSTEM

BACKGROUND OF THE INVENTION

This invention relates to locomotive combustion diesel engines, and, more particularly to the fuel filter systems used with the combustion engines for locomotives.

Given the vast terrain that locomotives may travel, the engines and engine accessory parts are often exposed to water. Temperature changes also create condensation within the fuel tank of the locomotive. Accordingly, water may contaminate the fuel tanks of locomotives. The locomotives are preferably operated with a maximum percentage of water to fuel of 0.1% of water by volume, within a fuel tank having a capacity of 5,000 gallons. The water and fuel are usually purged from the tank and engine system on 92 day cycles, and are progressing to 122 days through 180 days.

Fuel filters are used with locomotive internal combustion engines to separate various impurities from fuel including, but not limited to water. The fuel filter includes a filter media supported within a filter housing. As fuel is pumped into the filter, the filter media absorbs water thereby distorting the pore structure and shortening the filter media's life span.

Fuel filters in locomotives are mounted in a tilted position for maintenance purposes. A drain line connects the fuel filter to the fuel tank. A drain valve is disposed along the drain line between the fuel filter and the fuel tank. The drain valve is typically a ball valve in a normally closed position during operation of the locomotive. In order to maintain the filter, the ball valve is opened to flush out water and from the housing, as well as to empty the fuel tank during routine maintenance of the locomotive.

SUMMARY OF THE INVENTION

The maintenance cycle time for the fuel filter may be extended by utilizing a filter coated with a phenolic resin which contains silicone, a hydrophobic organic silicon compound. Accordingly, the silicone consists of hydrocarbon chains which have a strong affinity for the cellulose makeup of the filter media. Water introduced into the fuel filter with fuel is displaced because of the silicone's attachment to the filter media. The silicone coated filter media actually repels water.

Inasmuch as fuel filters used in connection with a locomotive internal combustion engines are mounted in a tilted position for maintenance purposes, water has a tendency to collect at the bottom wall of the filter housing adjacent an end of the housing. However, different from the previously described drain systems, the fuel filter is in fluid communication with the fuel tank during operation of the locomotive. The filtered water passes from the fuel filter through a drain portal to the fuel tank during operation of the locomotive. The flow of the water from the fuel filter to the fuel tank is maintained at a sufficient rate to minimize the amount of water that will be discharged back into the fuel tank. A strainer may be placed in a drain line to filter large particles that may clog the drain line.

This fuel filter and drain construction has advantages over previous fuel filter systems. Namely, the use of the silicone coated filter prolongs the maintenance cycle of fuel filters. In addition the drain system, permits water from the separated fuel to be discharged during operation of locomotive so water will not remain in the fuel filter to damage the filter media. However, the flow of water is regulated to minimize the volume of water discharged to the fuel tank during operation of the locomotive, and maintain the pressure within the fuel filter housing within acceptable limits so a sufficient differential exists for fuel to flow through the system.

DETAILED DESCRIPTION OF THE DRAWING

Figure 1:
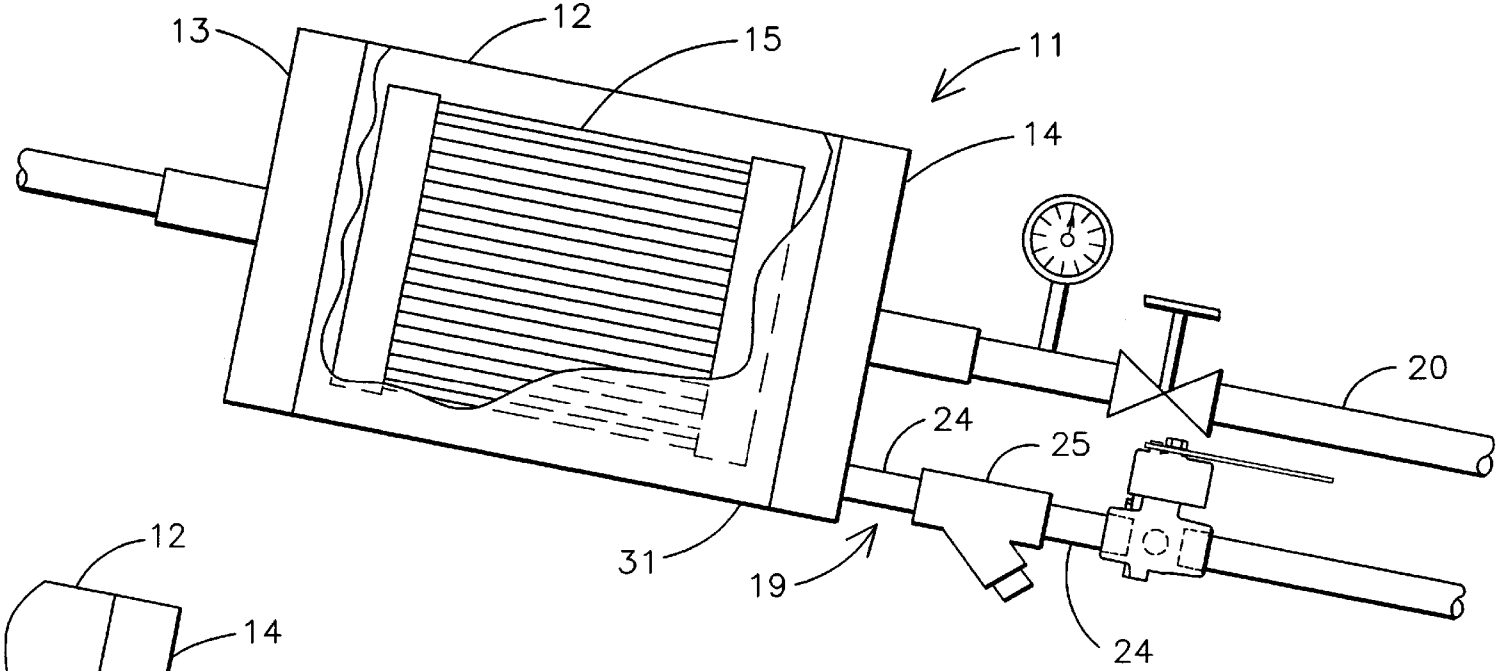
FIG. 1 is a side elevation view of the fuel filter and water drain system.
Figure 2:
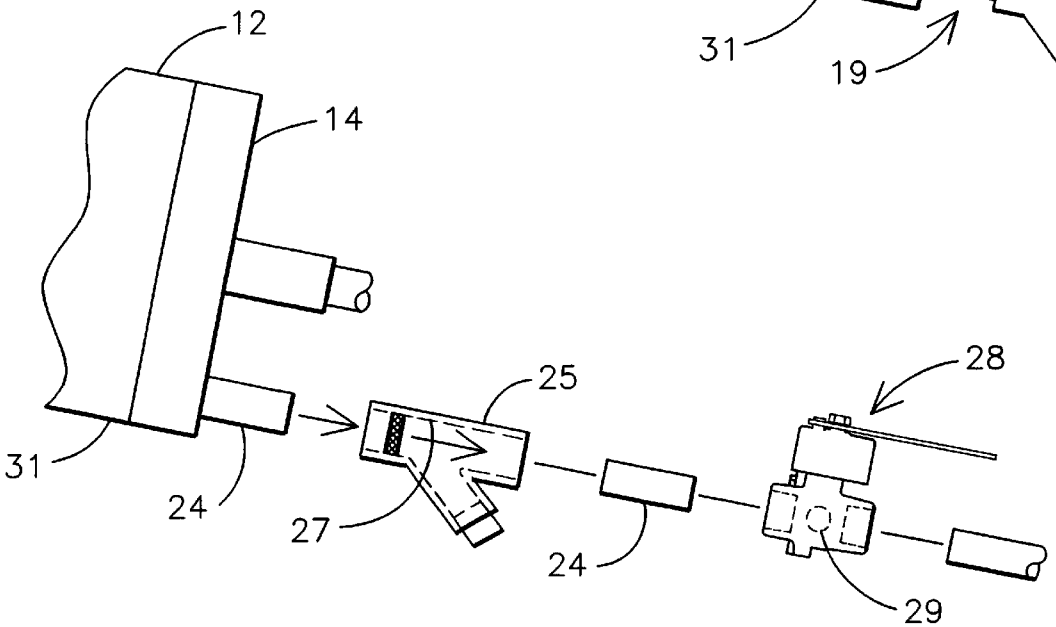
FIG. 2 is an exploded view of the water drain system.

Referring now to FIGS. 1 and 2, the water separation and drain system includes a fuel filter 11 which is used with a locomotive diesel engine to filter impurities from the diesel fuel. The fuel filter includes a housing 12 within which a filter media 15 is supported. The housing 12 has a first end 13 and second end 14. In a preferred embodiment the filter media 15 utilizes a silicone coated filter media which effectively reduces water absorption into the paper filter media, blocking water from passing through the filter media 15.

The fuel filter 11 is mounted in fluid communication with the fuel tank 22. Fuel filters 11 are usually mounted in a tilted position for maintenance purposes, with the first end 13 positioned above the second end 14. The longitudinal axis of the fuel filter is approximately ten degrees (10°), above horizontal. A fuel pump 23 operates to pump fuel at approximately sixty to ninety (60–90) pounds per square inch into the fuel filter 11. As fuel enters the fuel filter 11 and passes through the filter media 15, water is displaced because of the hydrophobic nature of the silicone coating. As fuel is continuously pumped through the fuel filter 11, water is repelled, and begins to collect in a collection area 31 along the wall of the filter housing 12 adjacent the second end 14 of the filter housing 12.

Figure 3:
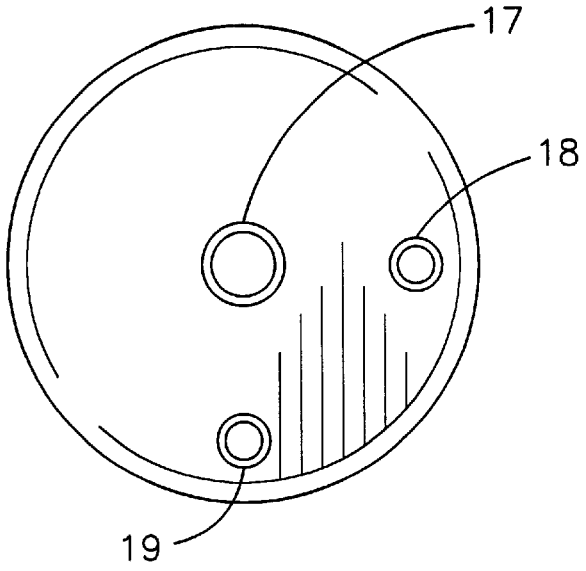
FIG. 3 is a front elevation view of the fuel filter.

Clean fuel filtered by the filter media 15 exits the fuel filter 11 via the second fuel line 20 where it is directed to the engine (not shown). With respect to FIG. 3, a front view of the fuel filter 11 is and second end cap 14 is shown. The fuel filter includes three portals including a fuel entrance portal 17, a fuel exit portal 18 and water drain portal 19. The first fuel line 20 connects the fuel tank 22 to the fuel filter 11 at the entrance portal 17. The clean fuel exits the fuel filter 11 through the fuel exit portal 18 to which the second fuel line 21 is attached. The drain portal 19 is positioned at the bottom of the second end cap 14 adjacent a water collection area 31 within the fuel filter 11.

The filter media may be of appropriate dimensions to meet the fuel. In the present invention, a fuel filter media is 30 inches long, ten inches in diameter and having pore diameters of (12) microns may be utilized where a maximum fuel pressure of 60–90 psi is maintained when the filter and an overall fuel flow rate of about seven gallons per minute is desirable.

The drain portal 19 and water drain line 30 are used with fuel filters for maintenance purposes. A valve 28 is disposed intermediate the fuel filter 11 and fuel tank 22. The valve 28 regulates the flow rate of water drained to the fuel tank during operation of the locomotive. The present invention uses a modified ball valve 28. Ball valves are normally disposed between the fuel filter 11 and the fuel tank 22 along the drain line 19. Ball valves remain in a normally closed position during the operation of the locomotive. When the fuel filters 11 are changed or otherwise maintained, the ball valve is opened to empty the fuel filter housing 12 of the water and other impurities.

In the present invention, the ball valve 28 has been modified to ensure that water is allowed to drain from the fuel filter 11 during the operation of the locomotive. The ball valve 28 includes a drain aperture 29. The aperture 29 is approximately 0.031 inches in diameter having been drilled through both sides of the ball. Fuel is pumped into the fuel filter 11 by the fuel pump 23 at approximately sixty to ninety pounds per square inch (60–90 psi). The fuel tank 22 is at substantially atmospheric pressure. Given the small diameter of the drain aperture 29 in the ball valve 28, a sufficient pressure differential exists to force water from the fuel filter 11 to the fuel tank 22 during operation of the locomotive. The drain aperture 29 maintains a steady flow of water of about ⅛ to ¼ gallons per minute.

In addition, a strainer 25 may be attached to the drain portal 19 by connector 24 between the fuel filter 11 and the ball valve 28. The strainer is connected to a ball valve 28 by a second connector 24. The strainer is a substantially y-shaped filtration device that is known to one skilled in the art. A screen 27 is mounted within the angularly disposed arm 32. The connectors 24 are preferably pipe nipples and secured to the strainer 25 in sealing relationship by pipe sealant.

Figure 4:
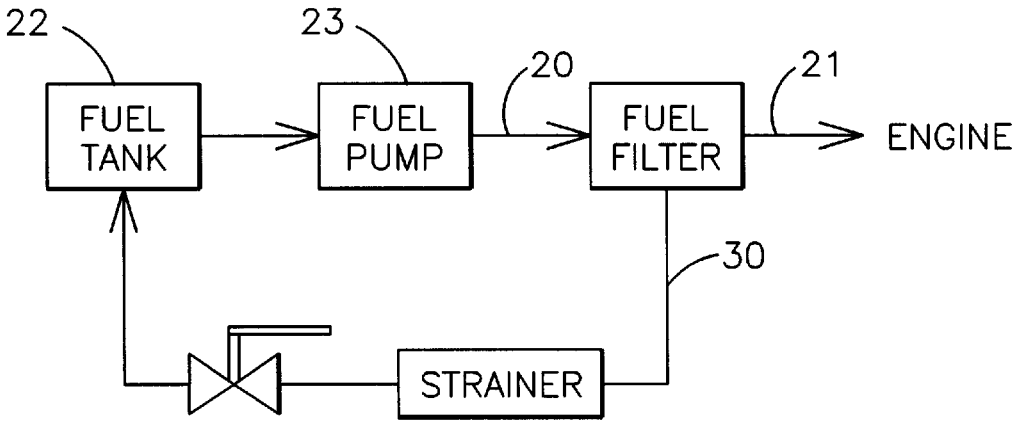
FIG. 4 is a flow chart showing the operation of the invention.

A flow chart is shown in FIG. 4, depicting the operation of the present invention. In operation, the fuel pump 23 forces fuel from the fuel tank 22 into the fuel filter 11 through the fuel entrance line 22 and portal 17. The fuel penetrates and passes through the filter media 15 and is directed to the engine. The silicone coated filter media 15 repels the water which consequently drains to the collection area 31 in the filter housing 12. The pressure differential between the fuel filter 11 and the fuel tank 22 is maintained despite the drain aperture 29 in the ball valve 28; and water is forced through the drain line 19 to the fuel tank 22. In this manner, water and other impurities are continuously purged from the fuel filter 11 during operation of the locomotive. In addition, the required pressure of about 60–90 psi is maintained within the fuel filter 11 so fuel continues to flow through the entire fuel system at a rate of about 7 gallons per minute within acceptable limits of the 7 gallons per minute.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A water separation and drain system for a locomotive diesel engine including a fuel filter having a housing, a first end, a second end and said fuel filter is mounted in fluid communication with a fuel tank on said locomotive, comprising:

a) a water repellent filter media supported in said housing;

b) a water collection area in fluid communication with said housing for collection of water separated from fuel by said filter media in which said water collection area is within the fuel filter housing adjacent to said second end of the filter housing, said second end of the filter has a drain portal; and c) means, disposed between said fuel filter and the fuel tank for regulating the flow rate of water from the fluid collection area to the fuel tank during operation of the locomotive in which the means for regulating water flow includes a drain line connecting the fuel filter to the filter tank at the drain portal, and a ball valve disposed between the water collection area and the fuel tank, and said ball valve has a drain aperture in the ball so the water collection area is in fluid communication with the fuel tank when the valve is in a normally closed position.

2. The water separation and drain system of claim 1, further including a strainer disposed between said drain portal and the ball valve.

3. A water separation and drain system for a locomotive diesel engine including a fuel filter having a housing, a first end cap, a second end, and said fuel filter is mounted in fluid communication with a fuel tank, comprising:

a) a water repellant filter media supported in said housing; and b) means, in fluid communication with the fuel tank, for continuously draining water from said fuel filter to the fuel tank, when water is separated from fuel by said filter media, during the operation of the locomotive, in which said means for draining water from the fuel filter to the fuel tank includes means, disposed between the fuel filter, to regulate the flow of water from the fuel filter and the fuel tank to the fuel tank during operation of the locomotive, in which the means for regulating the water flow from the fuel filter to the fuel tank is a ball valve having a drain aperture for fluid flow through said ball valve when said ball valve is in a normally closed position.

4. The water separation and drain system of claim 3 in which a strainer is disposed between the fluid filter and ball valve.

5. A fuel filter system for a diesel engine for separating impurities including water from fuel before delivery to the engine, the system comprising:

a) a housing for holding a filter media, having an inlet for receiving unfiltered fuel from a source thereof, a clean fuel outlet for delivery of filtered fuel to the engine and a water outlet for removal of water separated by the filter media, with the housing directing the flow of fuel within the housing to flow through the filter media;

b) said filter media being a water repellant filter media positioned in the housing for separating impurities including water from the fuel and presenting a resistance to flow creating a pressure drop across the filter media as the fuel flows through the media;

c) a water collection area in fluid flow communication with the water outlet for collecting water separated from the fuel by the filter media; and d) a fluid flow regulator in fluid flow communication with the water outlet for limiting the volume of fluid discharged from the housing via the water outlet and maintaining the pressure drop across the fuel filter in the housing wherein the fluid flow regulator comprises a ball valve having a drain aperture through a ball, when the valve is in a normally closed position.

* * * * *

UNITED STATES PATENT AND TRADEMARK OFFICE

CERTIFICATE OF CORRECTION

PATENT NO. : 6,371,087 B1
DATED : April 16, 2002
INVENTOR(S) : Keith A. Condran

It is certified that error appears in the above-identified patent and that said Letters Patent is hereby corrected as shown below:

Title page,
Please add Item -- [73] Assignee: General Electric Company --
Item [74], please add the following *Attorney, Agent or Firm*: -- Carl A. Rowold, Esquire. --

Signed and Sealed this

Tenth Day of December, 2002

JAMES E. ROGAN
*Director of the United States Patent and Trademark Office*